US006606978B2

(12) United States Patent
Sugimoto et al.

(10) Patent No.: US 6,606,978 B2
(45) Date of Patent: Aug. 19, 2003

(54) INTERNAL COMBUSTION ENGINE FUEL INJECTION APPARATUS AND CONTROL METHOD THEREOF

(75) Inventors: Tomojiro Sugimoto, Susono (JP); Keiso Takeda, Mishima (JP); Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 145 days.

(21) Appl. No.: 09/973,779

(22) Filed: Oct. 11, 2001

(65) Prior Publication Data

US 2002/0043250 A1 Apr. 18, 2002

(30) Foreign Application Priority Data

Oct. 18, 2000 (JP) ..... 2000-317737

(51) Int. Cl.[7] ..... F02M 51/00
(52) U.S. Cl. ..... 123/490; 123/478
(58) Field of Search ..... 123/490, 478, 123/90.11; 251/129.1

(56) References Cited

U.S. PATENT DOCUMENTS 6,148,791 A * 11/2000 Fujieda et al. ..... 123/295
6,257,190 B1 * 7/2001 Linebarger ..... 123/188.3
6,412,713 B2 * 7/2002 Okajima et al. ..... 239/585.1
6,422,836 B1 * 7/2002 Krueger et al. ..... 417/418
6,457,535 B1 * 10/2002 Tanaka ..... 173/48
6,511,319 B1 * 1/2003 Hunter ..... 433/122
6,513,467 B2 * 2/2003 Nohara et al. ..... 123/90.15

FOREIGN PATENT DOCUMENTS

JP A 7-239050 9/1995

* cited by examiner

*Primary Examiner*—John Kwon
(74) *Attorney, Agent, or Firm*—Oliff & Berridge PLC

(57) ABSTRACT

A fuel injection apparatus of an internal combustion engine includes a valve body movably disposed for back and forth movement in a fuel passage to open and close a fuel injection hole of the fuel injection apparatus. An armature is attached to the valve body. A valve-opening solenoid coil drives the armature in a valve-opening direction. A valve-closing solenoid coil drives the armature in a valve-closing direction. A controller that sets an overlap time, which is a time by which starting of electrifying of the valve-closing solenoid coil precedes stopping of electrifying of the valve-opening solenoid coil, controls the solenoid coils in accordance with a fuel pressure supplied to the fuel injection apparatus such that a valve-closing force on the valve body does not exceed an open valve holding force on the valve body prior to the time when stopping of the electrifying of the valve-opening solenoid coil occurs.

16 Claims, 7 Drawing Sheets

INTERNAL COMBUSTION ENGINE FUEL INJECTION APPARATUS AND CONTROL METHOD THEREOF

INCORPORATION BY REFERENCE

The disclosure of Japanese Patent Application No. 2000-317737 filed on Oct. 18, 2000, including the specification, drawings and abstract is incorporated herein by reference in its entirety.

BACKGROUND OF THE INVENTION

1. Field of Invention

The invention relates to an internal combustion engine fuel injection apparatus and a control method thereof.

2. Description of Related Art

Recently, with regard to the fuel injection apparatus of internal combustion engines, there is a demand for high precision in regulating the amount of fuel injected due to the need to perform a fine fuel injection control in accordance with the state of operation of an engine. For example, Japanese Patent Application Laid-Open No. 7-239050 discloses a technology in which a single armature for driving a needle valve is driven by using a valve-opening solenoid coil and a valve-closing solenoid coil that are independent from each other. The result of this technology is that the bouncing oscillation of the needle valve at the open/closing time is reduced and the precision regarding the amount of fuel injected is improved.

As for the timing of starting electrification of the valve-closing solenoid coil in the above-described conventional fuel injection apparatus, the electrification of the valve-closing solenoid coil is started at an overlap time prior to the stop of electrification of the valve-opening solenoid coil, so as to quickly and reliably perform the valve closing action. The "overlap time" herein refers to a time between a start of electrification of the valve-closing solenoid coil and the end of electrification of the valve-opening solenoid coil. After electrification of the valve-closing solenoid coil is started, the current through the valve-closing solenoid coil gradually increases. Thus, a certain time is required before the current through the valve-closing solenoid coil reaches a predetermined value that will cause the solenoid coil to produce a predetermined magnetic attraction force. Therefore, it is necessary to set an overlap time. The overlap time may also be termed "magnetization delay time" of the valve-closing solenoid coil.

More specifically, when a voltage is applied to a solenoid coil, current flows through the solenoid coil, so that a magnetic flux produced by the current produces a magnetic attraction force that attracts the armature. The current through the solenoid coil gradually increases with a time delay. Therefore, the magnetic attraction force, which is proportional to the magnitude of current, also gradually increases with a time delay. Hence, in order to produce a magnetic attraction force that immediately moves the needle valve in the valve-closing direction simultaneously with a stop of electrification of the valve-opening solenoid coil, the overlap time is set to an amount of delay time that is needed for the current through the valve-closing solenoid coil to reach a predetermined value. With such setting of the overlap time, the needle valve is moved in the valve-closing direction to close the fuel injection hole simultaneously with the stop of electrification of the valve-opening solenoid coil. Thus, a high-precision control of the fuel injection amount can be achieved.

In this case, the amount of fuel injection is determined by the open valve duration of the fuel injection valve. Therefore, variable factors in the electrification control are the timing of starting electrifying the valve-opening solenoid coil and the duration of its electrification. The aforementioned overlap time, that is, the time between the timing of starting electrifying the valve-closing solenoid coil and the stop of electrification of the valve-opening solenoid coil, is kept constant.

If the amount of fuel injection, the shape of fuel spray, or the like is to be changed in accordance with the state of operation of the internal combustion engine, the fuel pressure supplied to the fuel injection apparatus is changed in some cases, particularly in a direct injection type internal combustion engine or the like. If in such an engine, the fuel pressure supplied to the fuel injection apparatus is raised, the raised fuel pressure increases the force that urges the needle valve disposed within the fuel passage in the valve-closing direction. In correspondence with the amount of increase in the urging force in the valve-closing direction (caused by the increase in fuel pressure), the value of current that produces a magnetic attraction force needed to move the needle valve in the valve-closing direction is reduced. However, if the overlap time is fixed, the aforementioned reduced value of current is reached prior to the timing of stopping electrifying the valve-opening solenoid coil. Consequently, as the magnetic attraction force needed to move the needle valve in the valve-closing direction is reached (i.e., prior to the timing of stopping electrifying the valve-opening solenoid), the needle valve is driven in the valve-closing direction. Therefore, the needle valve is closed at an earlier timing. That is, the raised fuel pressure results in an open valve duration that is shorter than a control-targeted open valve duration. Hence, the problem of a reduced amount of fuel injection may occur.

SUMMARY OF THE INVENTION

Accordingly, it is an object of the invention to provide an internal combustion engine fuel injection apparatus having a valve-opening solenoid coil and a valve-closing solenoid coil which is capable of curbing the reduction in the amount of fuel injection caused by a failure in achieving a control-targeted open valve duration if the fuel pressure supplied to the fuel injection apparatus is raised in accordance with the state of operation of an internal combustion engine, and is therefore capable of regulating the amount of fuel injection with even higher precision.

In order to achieve the above and/or other objects, one aspect of the invention provides a fuel injection apparatus of an internal combustion engine including a valve body movably disposed for back and forth movement in a fuel passage to open and close a fuel injection hole of the fuel injection apparatus. An armature is attached to the valve body. A valve-opening solenoid coil drives the armature in a valve-opening direction. A valve-closing solenoid coil drives the armature in a valve-closing direction. A controller that sets an overlap time, which is a time by which starting of electrifying of the valve-closing solenoid coil precedes stopping of electrifying of the valve-opening solenoid coil, controls the solenoid coils in accordance with a fuel pressure supplied to the fuel injection apparatus such that a valve-closing force on the valve body does not exceed an open valve holding force on the valve body prior to the time when stopping of the electrifying of the valve-opening solenoid coil occurs.

Furthermore, in order to achieve the aforementioned and/or other objects, the invention also provides a control method of a fuel injection apparatus of an internal combustion engine, the fuel injection apparatus including a valve body movably disposed for back and forth movement in a fuel passage to open and close a fuel injection hole of the fuel injection apparatus, an armature attached to the valve body, a valve-opening solenoid coil to drive the armature in a valve-opening direction, and a valve-closing solenoid coil to drive the armature in a valve-closing direction. The control method includes the steps of: setting an overlap time, which is a time by which starting of electrifying of the valve-closing solenoid coil precedes stopping of electrifying of the valve-opening solenoid coil; and controlling the solenoid coils in accordance with a fuel pressure supplied to the fuel injection apparatus such that a valve-closing force on the valve body does not exceed an open valve holding force on the valve body prior to the time when stopping of the electrifying of the valve-opening solenoid coil occurs.

According to the internal combustion engine fuel injection apparatus and control method described above, a control is performed in accordance with the fuel pressure supplied to the fuel injection apparatus such that the valve-closing force on the valve body does not exceed the open valve holding force on the valve body prior to the time when stopping of the electrifying of the valve-opening solenoid coil occurs, even if the supplied fuel pressure changes. Therefore, even if the fuel pressure is set high, the open valve holding force on the valve body can be maintained by offsetting the amount of increase in the valve-closing force on the valve body. Hence, it is possible to substantially prevent a reduction in the open valve duration of the valve body and therefore prevent a reduction in the amount of fuel injected. Thus, the amount of fuel injection can be regulated with high precision.

BRIEF DESCRIPTION OF THE DRAWINGS

The above mentioned and other objects, features, advantages, technical and industrial significance of this invention will be better understood by reading the following detailed description of preferred embodiments of the invention, when considered in connection with the accompanying drawings, in which.

DETAILED DESCRIPTION OF PREFERRED EMBODIMENTS

In the following description and the accompanying drawings, the present invention will be described in more detail with reference to exemplary, preferred embodiments.

Figure 1:
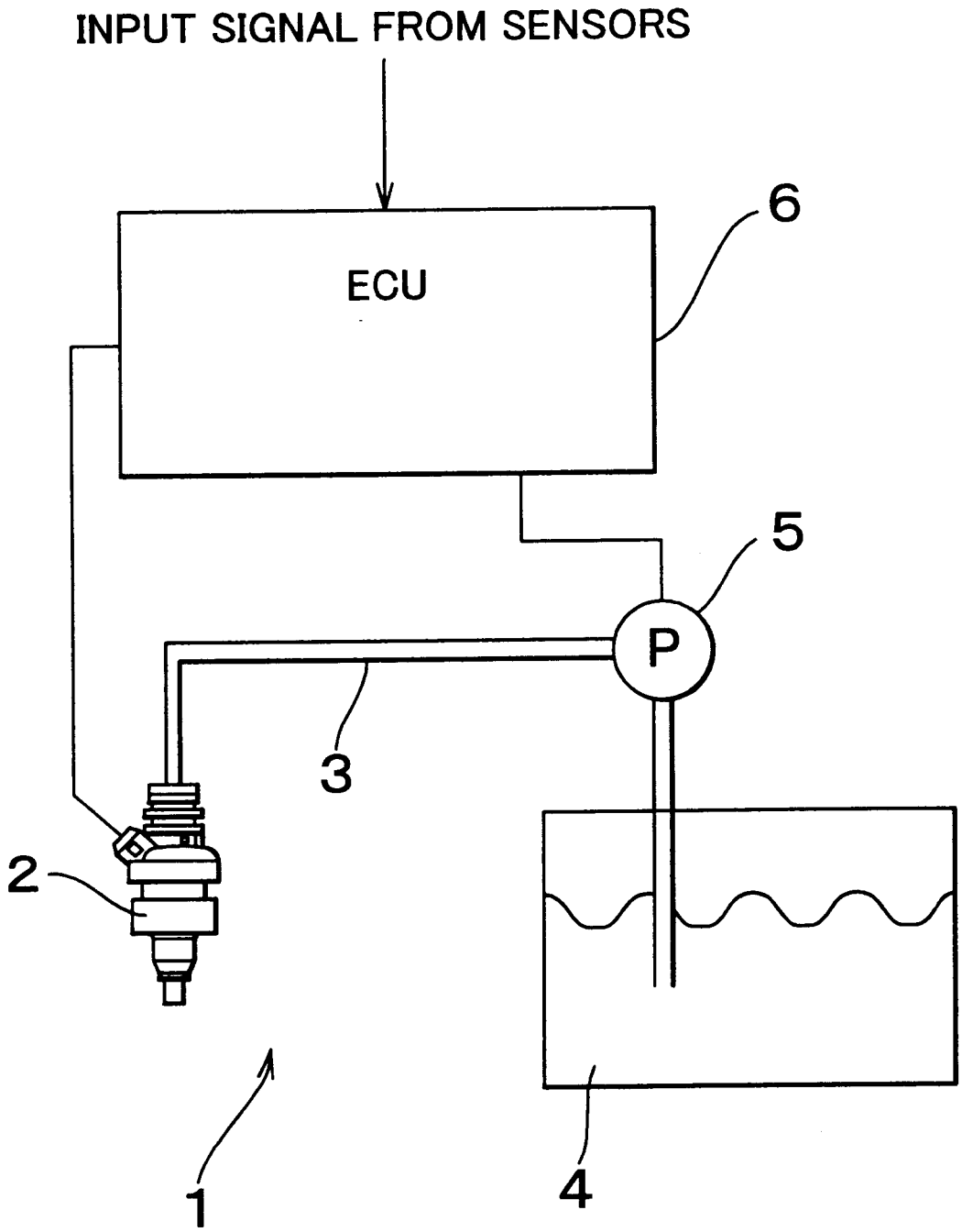
FIG. 1 is a diagram illustrating a construction of a fuel injection apparatus of an internal combustion engine in accordance with the invention.

FIG. 1 is a diagram illustrating a construction of a fuel injection apparatus 1 of an internal combustion engine in accordance with the invention. In FIG. 1, a fuel injection valve 2 is provided for injecting fuel into a combustion chamber (not shown) of the engine. The fuel injection valve 2 is connected to a fuel tank 4 that stores fuel, via a fuel supply pipe 3. The fuel supply pipe 3 is provided with a fuel pump 5 whose ejection amount can be changed based on the state of operation of the engine so as to change the fuel pressure supplied to the fuel injection valve 2. Using this fuel pump 5, fuel is supplied from the fuel tank 4 to the fuel injection valve 2. An ECU (electronic control unit) 6 is connected to various sensors (not shown) for detecting states of operation of the engine. On the basis of input signals from the sensors, the ECU 6 controls the fuel injection valve 2 and the fuel pump 5. In this embodiment, the ECU 6 has the functions of controlling the fuel pressure supplied by the pump 5, and setting the overlap time, etc., as described below.

Figure 2:
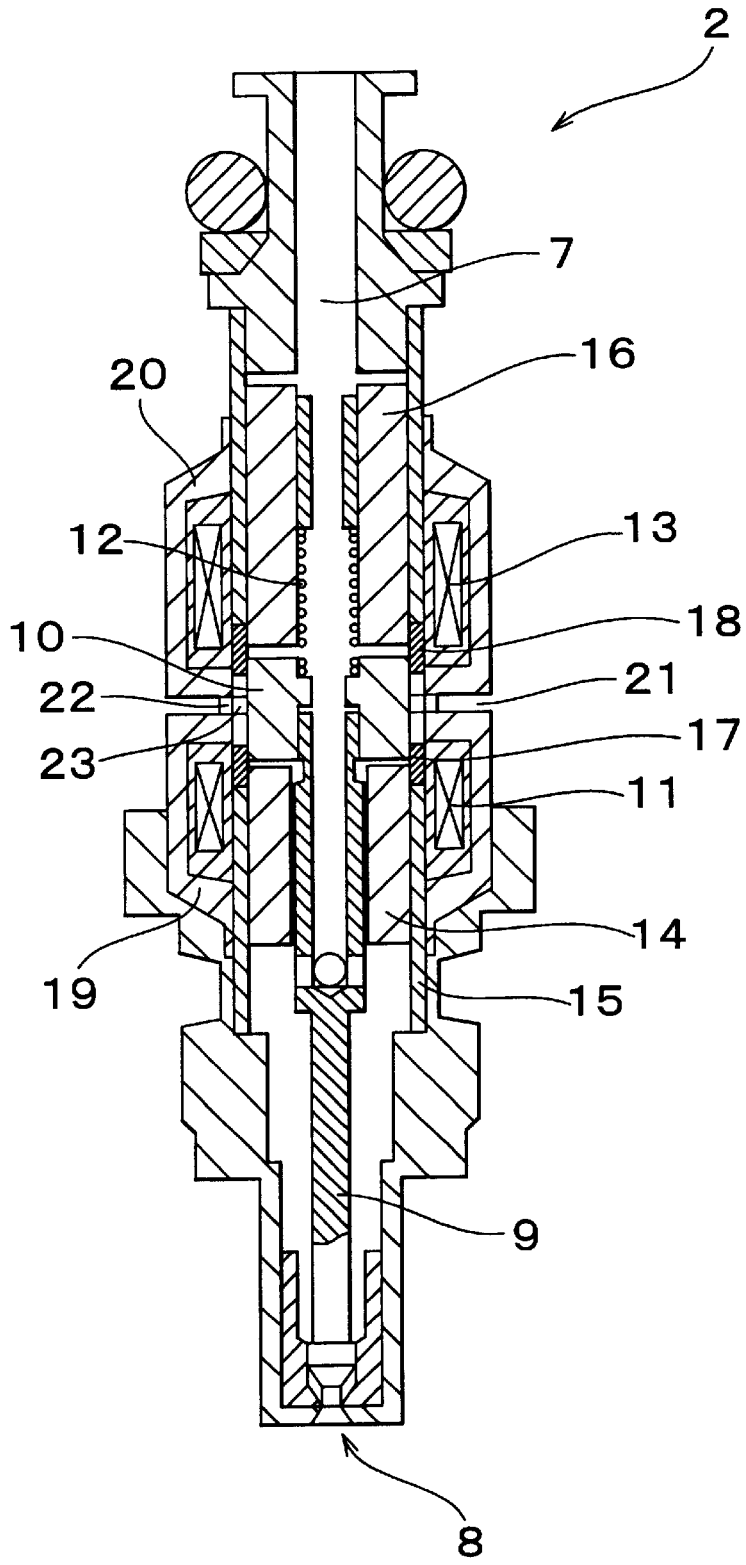
FIG. 2 is a schematic sectional view of a fuel injection valve in accordance with the invention.

FIG. 2 is a fragmental sectional side view of an embodiment of a fuel injection valve in accordance with the invention. The fuel injection valve 2 shown in FIG. 2 has a fuel supply passage 7 to which fuel ejected from the fuel pump 5 is supplied. The fuel injection valve 2 further has a fuel injection hole 8 for injecting fuel into the combustion chamber (not shown) of the engine, and a rod-like needle valve 9 for closing the fuel injection hole 8. Although only one fuel injection hole is formed in this embodiment, a plurality of fuel injection holes may be formed. An armature 10 is welded to an end portion of the needle valve 9 opposite from the fuel injection hole 8. The armature 10 has a substantially annular shape.

A valve-closing solenoid coil 11 is disposed at the fuel injection hole 8-side of the armature 10. The valve-closing solenoid coil 11 has a substantially annular shape, and surrounds the needle valve 9. The valve-closing solenoid coil 11 produces a magnetic field when voltage is applied to it. The magnetic field produced by the valve-closing solenoid coil 11 drives the armature 10 toward the fuel injection hole 8, that is, drives the needle valve 9 in such a direction as to close the fuel injection hole 8. The needle valve 9 is urged by a spring 12 that engages the armature 10. The spring 12 urges the needle valve 9 toward the fuel injection hole 8, that is, in the direction of closing the fuel injection hole 8.

Disposed at the fuel supply passage 7-side of the armature 10 is a valve-opening solenoid coil 13 that is separate from the valve-closing solenoid coil 11. The valve-opening solenoid coil 13 has a substantially annular shape, and surrounds the needle valve 9. Similarly to the valve-closing solenoid coil 11, the valve-opening solenoid coil 13 produces a magnetic field when voltage is applied thereto. Unlike the magnetic field produced by the valve-closing solenoid coil 11, the magnetic field produced by the valve-opening solenoid coil 13 drives the armature 10 away from the fuel injection hole 8, that is, drives the needle valve 9 in such a direction as to open the fuel injection hole 8.

In this embodiment, a voltage is applied to the valve-opening solenoid coil 13, but not to the valve-closing solenoid coil 11, when the fuel injection hole 8 is to be opened. As a result, the valve-opening solenoid coil 13 drives the needle valve 9 in the fuel injection hole-opening direction, overcoming the elastic force of the spring 12. Thus, the fuel injection hole 8 is opened, and fuel is injected from the fuel injection hole 8.

Conversely, when the fuel injection hole 8 is to be closed, the voltage applied to the valve-opening solenoid coil 13 is set to zero, and a voltage is applied to the valve-closing solenoid coil 11. As a result, the valve-closing solenoid coil 11 drives the needle valve 9 in the fuel injection hole-closing direction, with the assistance of the elastic force of the spring 12. Thus, the fuel injection hole 8 is closed, and the fuel injection from the fuel injection valve 2 stops.

The needle valve 9 is surrounded by a first guide wall 14 for guiding the reciprocating movements of the needle valve 9. The first guide wall 14 has a substantially cylindrical shape, and is disposed very close to the needle valve 9. The first guide wall 14 is contained in a substantially cylindrical sleeve 15. The spring 12 is surrounded by a second guide wall 16 for guiding the elongation and contraction of the spring 12. The second guide wall 16 has a substantially cylindrical shape, and is disposed very close to the spring 12. Similarly to the first guide wall 14, the second guide wall 16 is contained in the sleeve 15.

A first non-magnetic member 17 is disposed between the valve-closing solenoid coil 11 and the armature 10. A second non-magnetic member 18 is disposed between the valve-opening solenoid coil 13 and the armature 10. The nonmagnetic members 17, 18 have a substantially annular shape, and ensure that the magnetic fields produced by the solenoid coils 11, 13 have the appropriate effect on the armature 10. The valve-closing solenoid coil 11 is also surrounded by a first housing part 19. The first housing part 19 is attached onto the sleeve 15. The valve-opening solenoid coil 13 is surrounded by a second housing part 20 that is separate from the first housing part 19. The second housing part 20 is attached to the sleeve 15, similarly to the first housing part 19. The housing parts 19, 20 are spaced from each other, so that an insulating space 21 is formed between the housing parts 19, 20. The insulating space 21 ensures that the magnetic fields produced by the solenoid coils 11, 13 have the appropriate effect on the armature 10, as is the case with the non-magnetic members 17, 18.

A non-magnetic member 22 is disposed between the first housing part 19 and the second housing part 20. Another non-magnetic member 23 is disposed between the non-magnetic member 22 and the armature 10, in contact with the non-magnetic member 22. The non-magnetic members 22, 23 each have a substantially annular shape. The non-magnetic members 22, 23 serve to prevent overlap of the magnetic fields produced by the solenoid coils 11, 13.

Figure 3A:
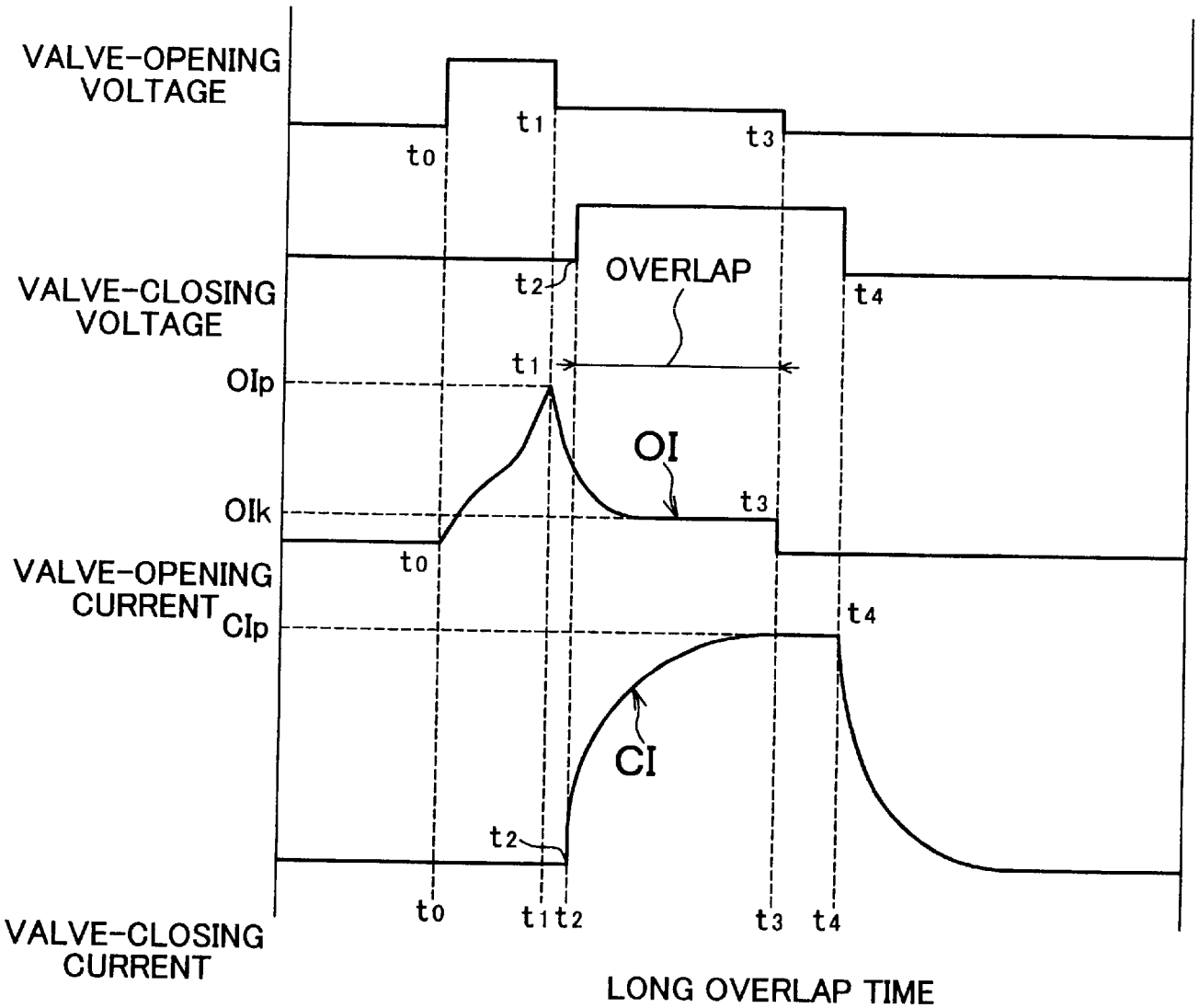
FIG. 3*a* is a graph indicating a relationship of the voltage applied to a valve-opening solenoid coil, a relationship of the voltage applied to a valve-closing solenoid coil, a relationship of the value of current through the valve-opening solenoid coil, and a relationship of the value of current through the valve-closing solenoid coil, with respect to time during a low-fuel pressure operation (with a long overlap time)
Figure 3B:
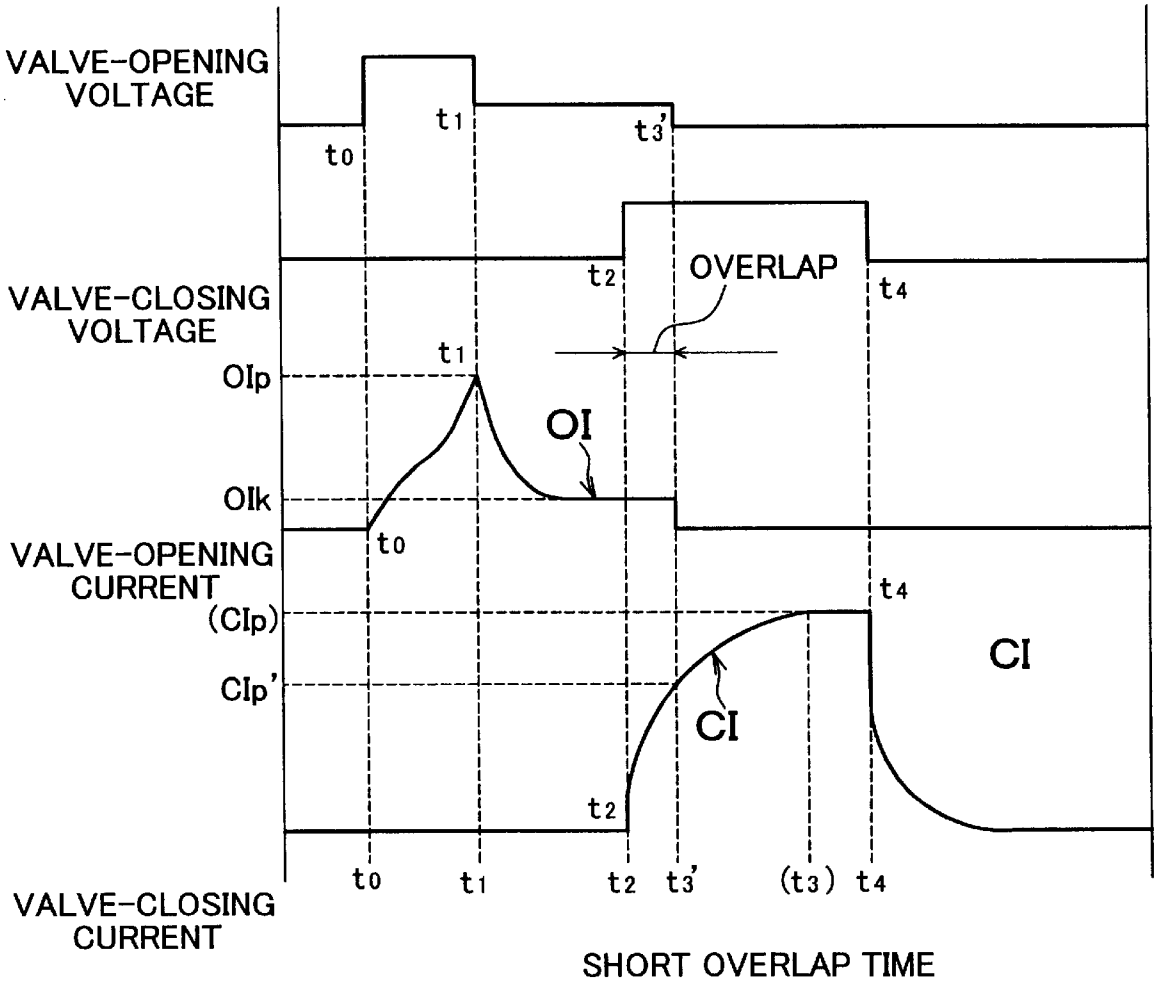
FIG. 3*b* is a graph indicating a relationship of the voltage applied to the valve-opening solenoid coil, a relationship of the voltage applied to the valve-closing solenoid coil, a relationship of the value of current through the valve-opening solenoid coil, and a relationship of the value of current through the valve-closing solenoid coil, with respect to time during a high-fuel pressure operation (with a short overlap time)

Operation of the fuel injection valve 2 in the embodiment will be described with reference to FIGS. 3*a* to 3*c*. FIG. 3*a* is a graph indicating a relationship of the voltage applied to the valve-opening solenoid coil 13, a relationship of the voltage applied to the valve-closing solenoid coil 11, a relationship of the value of current through the valve-opening solenoid coil 13, and a relationship of the value of current through the valve-closing solenoid coil 11, with respect to time during a low-fuel pressure operation. As indicated in FIG. 3*a*, upon application of a voltage to the valve-opening solenoid coil 13 at a time point t0, the valve-opening current OI through the valve-opening solenoid coil 13 starts to gradually rise. The magnetic flux produced by the valve-opening current OI produces a magnetic attraction force that draws the armature 10 in the valve-opening direction. The magnetic attraction force increases proportionally to the magnitude of the valve-opening current OI. At a time point t1, the value of current through the valve-opening solenoid coil 13 reaches a predetermined valve-opening current OIp that moves the needle valve 9 so as to completely open the fuel injection valve 2 overcoming the force of the spring 12 and the fuel pressure acting on the needle valve 9. Therefore, the fuel injection valve 2 is completely opened. If at the time point t1, the voltage applied to the valve-opening solenoid coil 13 is set to a predetermined open valve holding voltage value that maintains an open valve state, the value of current through the valve-opening solenoid coil 13 gradually decreases until the value of current is held at a predetermined open valve holding current value OIk that maintains the open valve state. The open valve holding force produced by the open valve holding current value OIk balances with the elastic force of the spring 12 and the fuel pressure, so that the open state of the needle valve 9 is maintained and fuel is injected from the fuel injection hole 8. Subsequently at a time point t3 when the voltage applied to the valve-opening solenoid coil 13 is discontinued, the fuel injection hole 8 is closed, thereby ending the valve opening control of the fuel injection valve 2.

In addition to the valve opening control of the fuel injection valve 2, a valve closing control described below is performed in this embodiment. That is, a voltage is applied to the valve-closing solenoid coil 11 at a time point t2 that is earlier than the time point t3 at which the voltage applied to the valve-opening solenoid coil 13 is discontinued, taking into account a magnetization delay time of the valve-closing solenoid coil 11 that elapses before the valve-closing current CI through the valve-closing solenoid coil 11 reaches a predetermined valve-closing current CIp that produces a magnetic attraction force needed to move the armature 10 in the valve-closing direction to completely close the fuel injection valve 2. Therefore, starting at the time point t2, the valve-closing current CI through the valve-closing solenoid coil 11 gradually rises. The magnetic flux produced by the valve-closing current CI produces a magnetic attraction force that draws the armature 10 in the valve-closing direction. The magnetic attraction force increases proportionally to the magnitude of the valve-closing current CI. At the time point t3, the value of current through the valve-closing solenoid coil 11 reaches the predetermined valve-closing current CIp that produces the magnetic attraction force to move the armature 10 in the valve-closing direction. Simultaneously, the voltage applied to the valve-opening solenoid coil 13 is discontinued, so that the valve-opening force disappears. Due to the valve-closing force based on the magnetic attraction force produced by the valve-closing current CIp in addition to the fuel pressure and the elastic force of the spring 12, the fuel injection valve 2 is immediately closed at the time point t3. Subsequently at a time point t4, the voltage applied to the valve-closing solenoid coil 11 is discontinued, thereby ending the valve-closing control.

The circuit for driving the valve-opening solenoid coil 13 preferably has an incorporated circuit that immediately sets the current through the valve-opening solenoid coil 13 to zero when the electrification of the valve-opening solenoid coil 13 stops. Therefore, at the time point t3 when the voltage applied to the valve-opening solenoid coil 13 is set to zero, the current through the valve-opening solenoid coil 13 immediately becomes zero as well. As a result, the magnetic attraction force exerted on the armature 10 in the valve-opening direction by the valve-opening solenoid coil 13 immediately disappears, and therefore the fuel injection valve 2 is immediately closed.

In this manner, the fuel injection valve is promptly closed at a targeted time by performing the valve-closing control in addition to the valve-opening control. Therefore, a target amount of fuel is injected from the fuel injection valve 2 without fail.

Figure 4:
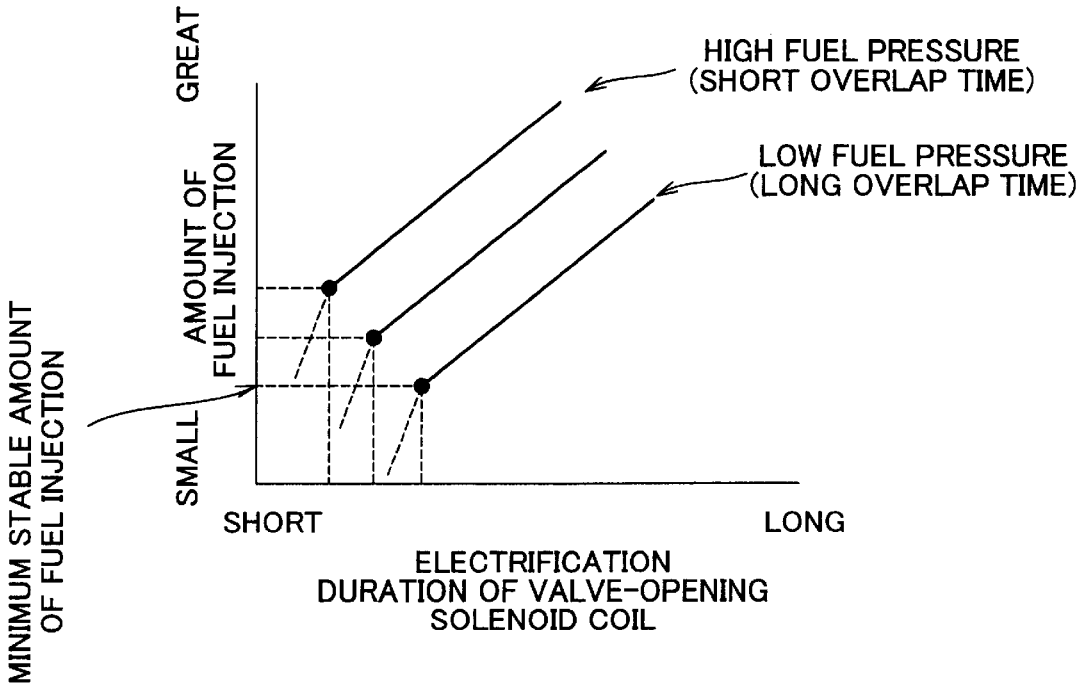
FIG. 4 is a graph indicating a relationship between the electrification duration of the valve-opening solenoid coil and the amount of fuel injection in accordance with the fuel pressure.

The amount of fuel injected is determined proportionally to the duration of electrification of the valve-opening solenoid coil 13 as indicated in FIG. 4. If the fuel pressure supplied to the fuel injection valve 2 is changed in accordance with the state of operation of the engine, the amount of fuel injected also changes depending on the fuel pressure. However, in an operation region where the electrification duration is short, there is a region where it is difficult to control the amount of fuel injection as intended because the amount of operation of the needle valve 9 is not completely dependent on the electrification duration due to construction factors of the fuel injection valve 2, more specifically, the set load of the spring 12, the fuel pressure, the responsiveness of the valve-closing/opening solenoid coils 11, 13, etc. Such an operation region varies depending on the fuel pressure, and a minimum amount of fuel injection that can be precisely controlled (minimum stable amount of fuel injection) is determined in accordance with the fuel pressure. The minimum stable amount of fuel injection decreases with decreases in the fuel pressure. Therefore, if a higher precision in regulating the amount of fuel injection is required, for example, when the amount of fuel injection is small, the fuel pressure is reduced. In contrast, if the requirement for a large amount of fuel injection is given higher priority than the requirement for a high precision in regulating the amount of fuel injection, for example, when the amount of fuel injection is large, the fuel pressure is increased.

Next will be described an operation of the fuel injection valve 2 performed in the embodiment when the fuel pressure is increased based on the state of operation of the engine. FIG. 3*b* is a graph indicating a relationship of the voltage applied to the valve-opening solenoid coil 13, a relationship of the voltage applied to the valve-closing solenoid coil 11, a relationship of the value of current through the valve-opening solenoid coil 13, and a relationship of the value of current through the valve-closing solenoid coil 11, with respect to time during a high-fuel pressure operation. As indicated in FIG. 3*b*, upon application of a voltage to the valve-opening solenoid coil 13 at a time point to, the valve-opening current OI through the valve-opening solenoid coil 13 starts to gradually rise. Subsequently at a time point t1, the value of current through the valve-opening solenoid coil 13 reaches the predetermined valve-opening current OIp, so that the fuel injection valve 2 is fully opened. After that, the value of current is held at the predetermined open valve holding current value OIk.

Since the fuel pressure supplied to the fuel injection valve 2 is high based on a request regarding the operation of the engine, the force that urges the needle valve 9 in the valve-closing direction is also great corresponding to the high fuel pressure. Therefore, in this case, the magnitude of magnetic attraction force that moves the armature 10 in the valve-closing direction is smaller than during the low-fuel pressure operation by the amount of increase in the valve-closing force caused by the raised fuel pressure. That is, such a magnitude of magnetic attraction force is produced by a correspondingly reduced valve-closing current CIp'. Therefore, if an overlap time equal to the overlap time set for the low-fuel pressure operation (FIG. 3*a*) is set, the value of current through the valve-closing solenoid coil 11 will reach CIp' before a time point t3' (FIG. 3*b*) at which the voltage applied to the valve-opening solenoid coil 13 is discontinued. Then, the valve-closing force produced by the predetermined valve-closing current value CIp' will exceed the valve-opening force that is produced by the predetermined open valve holding current value OIk so as to balance with the fuel pressure and the elastic force of the spring 12, so that the needle valve 9 will be moved in the valve-closing direction. As a result, the amount of fuel injection will be reduced.

Therefore, for the high-fuel pressure operation, a shortened overlap time is set by delaying the timing of starting electrifying the valve-closing solenoid coil 1 so that the predetermined valve-closing current value CIp' that produces a magnitude of magnetic attraction force that allows a movement of the armature 10 in the valve-closing direction will occur at the time point t3' at which the voltage applied to the valve-opening solenoid coil 13 is discontinued. (As can be appreciated by comparing FIGS. 3*a* and 3*b*, the time between t1 and t2 is much greater in FIG. 3*b* than in FIG. 3*a*.) Since the short overlap time is set during the high-fuel pressure operation, the amount of increase in the valve-closing force caused by the raised fuel pressure is offset.

Figure 5:
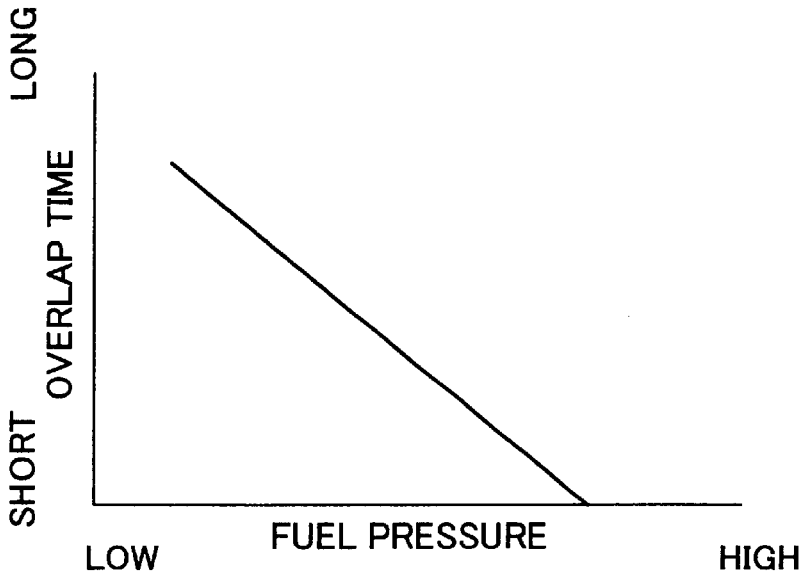
FIG. 5 is a graph indicating a relationship between the fuel pressure and the overlap time.

That is, according to the embodiment, if the fuel pressure supplied to the fuel injection valve 2 is changed, the set overlap time is reduced with increases in the fuel pressure as indicated in FIG. 5, so as to offset the amount of increase in the valve-closing force caused by the increased fuel pressure.

Figure 3C:
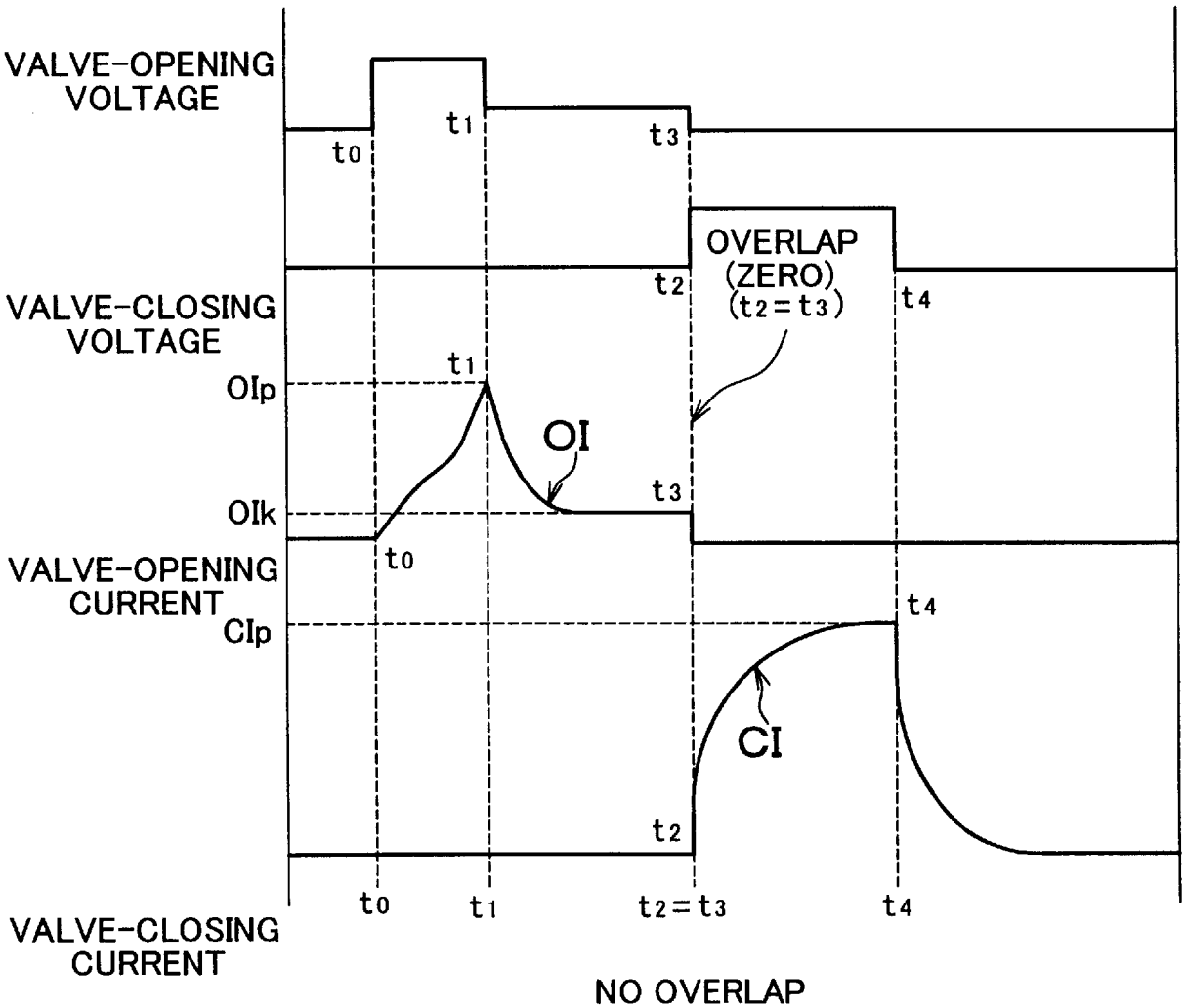
FIG. 3*c* is a graph indicating a relationship of the voltage applied to the valve-opening solenoid coil, a relationship of the voltage applied to the valve-closing solenoid coil, a relationship of the value of current through the valve-opening solenoid coil, and a relationship of the value of current through the valve-closing solenoid coil, with respect to time during an operation with the overlap time set to zero.

If the fuel pressure is further raised, the overlap time may be set to zero to considerably delay the start timing of a rise in the valve-closing force produced by the valve-closing solenoid coil 11 as indicated in FIG. 3*c*. In this manner, the amount of increase in the valve-closing force caused by the raised fuel pressure can be offset, and therefore the reduction in the amount of fuel injection can be curbed.

As described above, if the set overlap time is decreased with increases in the fuel pressure, the start timing of the rise in the valve-closing force produced by the valve-closing solenoid coil is correspondingly delayed. Therefore, it is possible to offset the amount of increase in the valve-closing force caused by the raised fuel pressure while adopting an inexpensive construction without adding any special device. Furthermore, it is possible to curb the reduction in the amount of fuel injection caused by the increase in the valve-closing force caused by the raised fuel pressure while securing the minimum stable amount of fuel injection for the low-fuel pressure operation. Consequently, the amount of fuel injection can be regulated with high precision even if the fuel pressure is changed in accordance with the state of operation.

Figure 6:
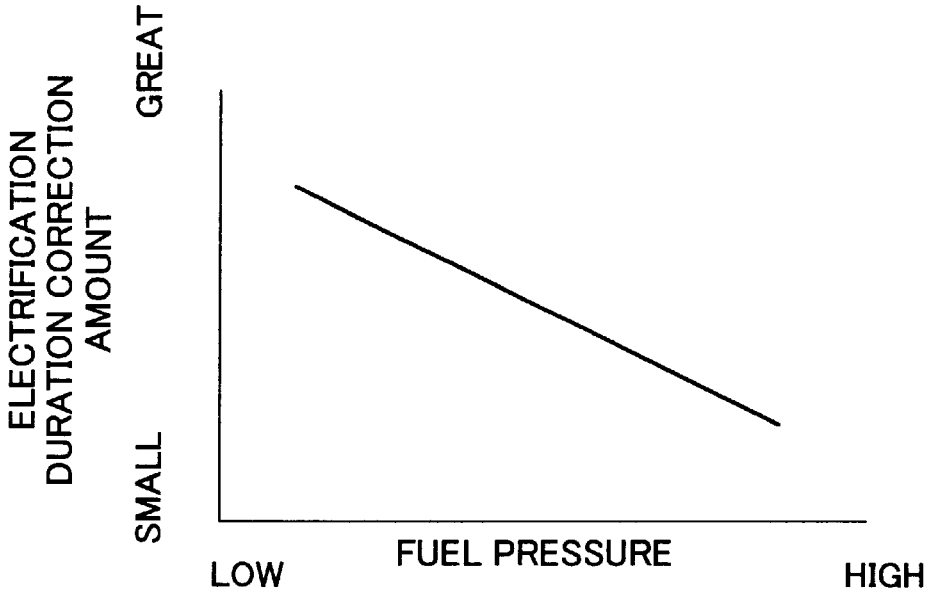
FIG. 6 is a fuel injection amount correction map based on the fuel pressure.

The amount of fuel injection varies depending on the fuel pressure, even if the electrification duration is fixed. Therefore, if an injection amount correction map is set such that the duration of electrification of the valve-opening solenoid coil 13 is decreased with increases in the fuel pressure as indicated in FIG. 6, a fuel injection control with a higher precision in regulating the amount of fuel injection can be performed.

The correction of injection amount in accordance with the fuel pressure or the setting of the overlap time may be calculated based on the state of operation of the engine detected by the sensors connected to the ECU 6, on an as-needed basis. In a simplest method, however, various data concerned are prepared as maps beforehand. By referring to such map data in accordance with the state of operation detected by the sensors connected to the ECU 6, a basic fuel pressure, the timings of starting and stopping electrifying the valve-opening solenoid coil 13, and the valve-closing solenoid coil electrification start timing that reflects the overlap time corresponding to the set fuel pressure are read out. Then, the drive control of the fuel pump 5 and the electrification control of the solenoid coils 11, 13 are performed based on the values read from the map data.

As for the fuel pressure, a simple setting of two values, such as a low fuel pressure and a high fuel pressure, is possible. In accordance with the two values of fuel pressure, two overlap times, that is, an overlap time corresponding to the low fuel pressure and a shorter overlap time corresponding to the high fuel pressure, may be provided. In still another possible example of the setting, the fuel pressure is continuously changed from a low fuel pressure to a high fuel pressure, and the overlap time is continuously decreased with increases in the fuel pressure.

In the foregoing embodiment, the overlap time is changed in the electrification control of the solenoid coils for offsetting the amount of increase in the valve-closing force on the needle valve caused by raised fuel pressure. However, the electrification control in accordance with the invention is not limited to the embodiment, but may be any other control whereby the electrification of at least one of the valve-opening solenoid coil and the valve-closing solenoid coil is controlled in accordance with the pressure of fuel supplied to the fuel injection apparatus so that the valve-closing force on the needle valve does not exceed the open valve holding force on the needle valve prior to the timing of stopping electrifying the valve-opening solenoid coil.

For example, it is feasible to adopt a construction in which the voltage applied to the valve-opening solenoid coil is variably controlled in accordance with the fuel pressure, and in which an electrification control is performed such that the amount of increase in the valve-closing force caused by raised fuel pressure is offset by increasing the open valve hold voltage applied to the valve-opening solenoid coil, and the open state of the needle valve is thereby maintained. In another feasible construction, the voltage applied to the valve-closing solenoid coil is variably controlled in accordance with the fuel pressure, and an electrification control is performed so as to decrease the voltage applied to the valve-closing solenoid coil. In still another feasible construction, a variable resistor is provided in a solenoid coil drive circuit, and an electrification control is performed such that the value of current through the valve-opening or valve-closing solenoid coil is increased or decreased in accordance with changes in the fuel pressure so as to offset the amount of increase in the valve-closing force on the needle valve caused by raised fuel pressure.

Thus, if the electrification of at least one of the valve-opening solenoid coil and the valve-closing solenoid coil is controlled in accordance with the pressure of fuel supplied to the fuel injection apparatus so that the valve-closing force on the needle valve does not exceed the open valve holding force on the needle valve prior to the timing of stopping electrifying the valve-opening solenoid coil, the amount of increase in the valve-closing force on the needle valve caused by raised fuel pressure can be offset. Therefore, it is possible to curb the reduction in the amount of fuel injection caused by the increase in the valve-closing force caused by raised fuel pressure while securing the minimum stable amount of fuel injection for the low-fuel pressure operation. Therefore, the amount of fuel to be injected can be regulated with high precision even if the fuel pressure changes in accordance with the state of operation of the engine.

Furthermore, during a high-fuel pressure operation during which the amount of fuel injection is great so that the minimum amount of fuel injection that can be accurately controlled (minimum stable amount of fuel injection) may be a relatively great amount, the fuel injection valve can be immediately driven in the valve-closing direction merely by the valve-closing force based on the spring force and the fuel pressure, and demagnetization of the valve-opening solenoid coil. Therefore, a sufficient precision in the amount regulation can be achieved without a need for electrification of the valve-closing solenoid coil. Hence, if the electrification of the valve-closing solenoid coil is prohibited when the fuel pressure reaches or exceeds a predetermined value, it becomes possible to simplify the control while achieving high-precision regulation of the amount of fuel injection by curbing the reduction in the amount of fuel injection caused by the increase in the valve-closing force caused by raised fuel pressure and securing the minimum stable amount of fuel injection for the low-fuel pressure operation.

According to the internal combustion engine fuel injection apparatus and the control method thereof in accordance with one embodiment of the invention, if the pressure of fuel supplied to the fuel injection apparatus changes in accordance with the state of operation of the engine, the set overlap time is reduced with increases in the fuel pressure, so that the amount of increase in the valve-closing force caused by raised fuel pressure is offset by a delay in the start timing of the rise in the valve-closing force produced by the valve-closing solenoid coil. Therefore, the reduction in the amount of fuel injection caused by the increase in the valve-closing force caused by raised fuel pressure can be curbed. Hence, the amount of fuel injection can be regulated with high precision even if the fuel pressure changes in accordance with the state of operation.

Furthermore, according to the internal combustion engine fuel injection apparatus and the control method thereof of one embodiment of the invention, if the pressure of fuel supplied to the fuel injection apparatus changes in accordance with the state of operation of the engine, the electrification of at least one of the valve-opening solenoid coil and the valve-closing solenoid coil is controlled in accordance with the fuel pressure supplied to the fuel injection apparatus so that the valve-closing force on the needle valve does not exceed the open valve holding force on the needle valve prior to the timing of stopping electrifying the valve-opening solenoid coil. Therefore, it is possible to offset the amount of increase in the valve-closing force on the needle valve caused by raised fuel pressure and therefore curb the reduction in the amount of fuel injection caused by the increase in the valve-closing force caused by the raised fuel pressure. Hence, the amount of fuel injection can be regulated with high precision even if the fuel pressure changes in accordance with the state of operation.

Still further, according to the internal combustion engine fuel injection apparatus and the control method thereof of one embodiment of the invention, during a high-fuel pressure operation during which the minimum stable amount of fuel injection may be relatively large, the electrification of the valve-closing solenoid coil is prohibited if the fuel pressure is equal to or greater than a predetermined pressure value. Therefore, the control can be simplified, and the reduction in the amount of fuel injection caused by the increase in the valve-closing force caused by raised fuel pressure can be curbed. Hence, the amount of fuel injection can be regulated with high precision even if the fuel pressure changes in accordance with the state of operation.

In the illustrated embodiment, the controller (ECU 6) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A fuel injection apparatus of an internal combustion engine, comprising:

a valve body movably disposed for back and forth movement in a fuel passage to open and close a fuel injection hole of the fuel injection apparatus;

an armature attached to the valve body;

a valve-opening solenoid coil that drives the armature in a valve-opening direction;

a valve-closing solenoid coil that drives the armature in a valve-closing direction; and a controller that sets an overlap time, which is a time by which starting of electrifying of the valve-closing solenoid coil precedes stopping of electrifying of the valve-opening solenoid coil, and that controls the solenoid coils in accordance with a fuel pressure supplied to the fuel injection apparatus such that a valve-closing force on the valve body does not exceed an open valve holding force on the valve body prior to the time when stopping of the electrifying of the valve-opening solenoid coil occurs.

2. A fuel injection apparatus of an internal combustion engine, according to claim 1, wherein the controller changes the overlap time in accordance with the fuel pressure supplied to the fuel injection apparatus so that the valve-closing force on the valve body does not exceed the open valve holding force on the valve body prior to the time when stopping of the electrifying of the valve-opening solenoid coil occurs.

3. A fuel injection apparatus of an internal combustion engine, according to claim 2, wherein the controller sets the overlap time so that the overlap time decreases as the fuel pressure supplied to the fuel injection apparatus increases.

4. A fuel injection apparatus of an internal combustion engine according to claim 2, wherein the controller sets the overlap time to zero when the fuel pressure supplied to the fuel injection apparatus is at least a predetermined value.

5. A fuel injection apparatus of an internal combustion engine according to claim 1, wherein the controller controls an electrification condition of at least one of the valve-opening solenoid coil and the valve-closing solenoid coil so that the valve-closing force on the valve body does not exceed the open valve holding force on the valve body prior to the time when stopping of the electrifying of the valve-opening solenoid coil occurs.

6. A fuel injection apparatus of an internal combustion engine according to claim 5, wherein the controller changes a voltage condition of at least one of the valve-opening solenoid coil and the valve-closing solenoid coil in accordance with the fuel pressure so that the valve-closing force on the valve body does not exceed the open valve holding force on the valve body prior to the time when stopping of the electrifying of the valve-opening solenoid coil occurs.

7. A fuel injection apparatus of an internal combustion engine according to claim 6, wherein the controller increases a voltage across the valve-opening solenoid coil when the fuel pressure increases.

8. A fuel injection apparatus of an internal combustion engine according to claim 6, wherein the controller reduces a voltage across the valve-closing solenoid coil when the fuel pressure increases.

9. A fuel injection apparatus of an internal combustion engine according to claim 5, wherein the controller prohibits electrification of the valve-closing solenoid coil when the fuel pressure is at least a predetermined pressure value.

10. A control method of a fuel injection apparatus of an internal combustion engine, the fuel injection apparatus including a valve body movably disposed for back and forth movement in a fuel passage to open and close a fuel injection hole of the fuel injection apparatus, an armature attached to the valve body, a valve-opening solenoid coil to drive the armature in a valve-opening direction, and a valve-closing solenoid coil to drive the armature in a valve-closing direction, the control method comprising:

setting an overlap time, which is a time by which starting of electrifying of the valve-closing solenoid coil precedes stopping of electrifying of the valve-opening solenoid coil; and controlling the solenoid coils in accordance with a fuel pressure supplied to the fuel injection apparatus such that a valve-closing force on the valve body does not exceed an open valve holding force on the valve body prior to the time when stopping of the electrifying of the valve-opening solenoid coil occurs.

11. A control method according to claim 10, wherein the controlling step includes changing the overlap time in accordance with the fuel pressure supplied to the fuel injection apparatus so that the valve-closing force on the valve body does not exceed the open valve holding force on the valve body prior to the time when stopping of the electrifying of the valve-opening solenoid coil occurs.

12. A control method according to claim 11, wherein the overlap time is decreased as the fuel pressure supplied to the fuel injection apparatus is increased, or the overlap time is set to zero when the fuel pressure is at least a predetermined value.

13. A control method according to claim 10, wherein the controlling step includes changing a voltage or a value of current of at least one of the valve-opening solenoid coil and the valve-closing solenoid coil in accordance with the fuel pressure supplied to the fuel injection apparatus so that the valve-closing force on the valve body does not exceed the open valve holding force on the valve body prior to the time when stopping of the electrifying of the valve-opening solenoid coil occurs.

14. A control method according to claim 13, wherein the voltage across the valve-opening solenoid coil or the value of current through the valve-opening solenoid coil is increased when the fuel pressure increases.

15. A control method according to claim 13, wherein the voltage across the valve-closing solenoid coil or the value of current through the valve-closing solenoid coil is reduced when the fuel pressure increases.

16. A control method according to claim 10, wherein the controlling step includes prohibiting electrification of the valve-closing solenoid coil when the fuel pressure is at least a predetermined value so that the valve-closing force on the valve body does not exceed the open valve holding force on the valve body prior to the time when stopping of the electrifying of the valve-opening solenoid coil occurs.

* * * * *